United States Patent [19]

Pietsch et al.

[11] 4,318,341

[45] Mar. 9, 1982

[54] INK FOUNTAIN FOR PRINTING PRESS

[75] Inventors: Erich Pietsch, Offenbach-Bieber; Claus Simeth, Offenbach am Main, both of Fed. Rep. of Germany

[73] Assignee: M.A.N.-Roland Druckmaschinen Aktiengesellschaft, Fed. Rep. of Germany

[21] Appl. No.: 186,333

[22] Filed: Sep. 11, 1980

[30] Foreign Application Priority Data

Sep. 13, 1979 [DE] Fed. Rep. of Germany ..... 2937037

[51] Int. Cl.[3] ..... B41F 31/04; B41F 31/06; B41F 33/00; B41L 27/06

[52] U.S. Cl. ..... 101/365

[58] Field of Search ..... 101/365, 350, 363, 207, 101/208, 210; 118/261

[56] References Cited

U.S. PATENT DOCUMENTS

| | | | |
|---|---|---|---|
| 3,057,294 | 10/1962 | Jameson | 101/365 |
| 3,898,931 | 8/1975 | Posselt | 101/365 |
| 4,000,694 | 1/1977 | Schroder | 101/365 |
| 4,159,651 | 7/1979 | MacPhee | 101/365 X |

FOREIGN PATENT DOCUMENTS

| | | | |
|---|---|---|---|
| 2550720 | 6/1977 | Fed. Rep. of Germany | 101/365 |

*Primary Examiner*—J. Reed Fisher

*Attorney, Agent, or Firm*—Leydig, Voit, Osann, Mayer & Holt, Ltd.

[57] ABSTRACT

An ink fountain construction for a printing press having a trough extending adjacent and parallel to the fountain roller to define a control space occupied by a flow control strip. The control strip is made up of a series of separate and independent flow control segments in the form of identical blocks of rectangular shape arranged snugly side-by-side for zonal control of the ink film fed to the roller. Each segment is rigidly secured to the frame at its lower end. Each segment has a relatively thin central section and is sprung forwardly to bias the presented upper edge of the segment against the fountain roller. A set of pull rods connected to the upper ends of the segments have adjusting means at the rear end to draw the connected segment rearwardly to define a gap with the fountain roller to establish the rate of ink feed in the respective zonal position. A resilient sealing strip is sandwiched between the front edge of the frame and the flow control segments under edgewise compression thereby to follow the movements of the individual segments over the entire range of adjustment while maintaining a constant seal between the segments and the front edge of the frame.

4 Claims, 6 Drawing Figures

INK FOUNTAIN FOR PRINTING PRESS

In ink fountains in lithographic and other types of printing presses provision is normally made for feeding different amounts of ink to different zonal or column positions since the subject matter of some of the column positions requires application of ink at a different average density. Where the usual fountain blade is used with a plurality of adjusting screws the stiffness of the blade makes it inevitable that making an adjustment in one position will produce an unwanted change in the ink fed in the adjacent positions.

In an effort to minimize the interference which occurs between the adjacent adjusting devices it has been proposed to subdivide the blade adjacent its metering edge. Examples of this are to be found in German Publication documents DE-AS Nos. 2,460,116 and 2,514,519. In both of such structures it is impossible to achieve a precise setting of the inking device without interference with adjoining zones.

To further reduce the interference it has been proposed that the control element for each zone be formed as a separate piece having provision for separate endwise adjustment as shown, for example, in U.S. Pat. No. 3,978,788. However, in such construction the ink control elements are interconnected by resilient "buttons" interposed between them with the result that adjacent sections can have an affect upon one another, particularly where a certain amount of lost motion is present.

It is, accordingly, an object of the present invention to provide a construction of ink fountain which permits precise and sensitive adjustment of the ink which is fed in each zonal position over the entire width of the fountain roller and completely free of mutual interference between adjoining zones. Thus if the press requires feeding of additional ink in a selected column or zonal position, the need for ink in such position can be satisfied by localized adjustment without producing, at the same time, feeding of excess ink into the marginal portions of adjacent zones or columns.

It is a related object to provide an ink flow adjusting arrangement for an ink fountain which can be easily and quickly calibrated and which is entirely free of lost motion, making the settings of the control elements completely and accurately reproducible.

It is another object of the invention to provide an ink feed control, or dosing, arrangement for an ink fountain which employs independently movable control elements for zone by zone control, but with all of the elements being positively sealed against leakage not only under conditions of shut-off but over the entire range of gap adjustment. In this connection it is an object to provide a device for zonal control of ink feed in which the flow control strip is made up of a series of separate and independent segments in the form of identical blocks of rectangular shape snugly arranged sid-by-side and providing sufficient lateral area in engagement ot avoid any possibility of leakage between them.

It is a related object to provide an ink flow control arrangement for an ink fountain which is adjustable over a wide range in rate of feed and which is securely and constantly sealed over the entire range even where large differences occur in rate of feed between adjacent control segments.

It is another object of the present inveniton to provide an ink feed control arrangement which employs cantilever-supported beam segments stressed in the bending mode as zonal flow controlelements and having such a high spring rate as to be able to assume accurate positions of adjustment in both the flow increasing and flow decreasing directions regardless of accumulations of gummy or dried-on ink.

Finally it is an object of the invention to provide an ink flow control arrangement for a printing press which, notwithstanding the above benefits, is extremely simple and economical to construct and maintain.

Other objects and advantages of the invention will become apparent upon reading the attached detailed description and upon reference to the drawings in which.

While the invention has been described herein in connection with a preferred embodiment, it will be understood that we do not intend to be limited to the particular embodiment shown but intend, on the contrary, to cover the various alternative and equivalent forms of the invention included within the spirit and scope of the appended claims.

Figures 1, 2, 3:
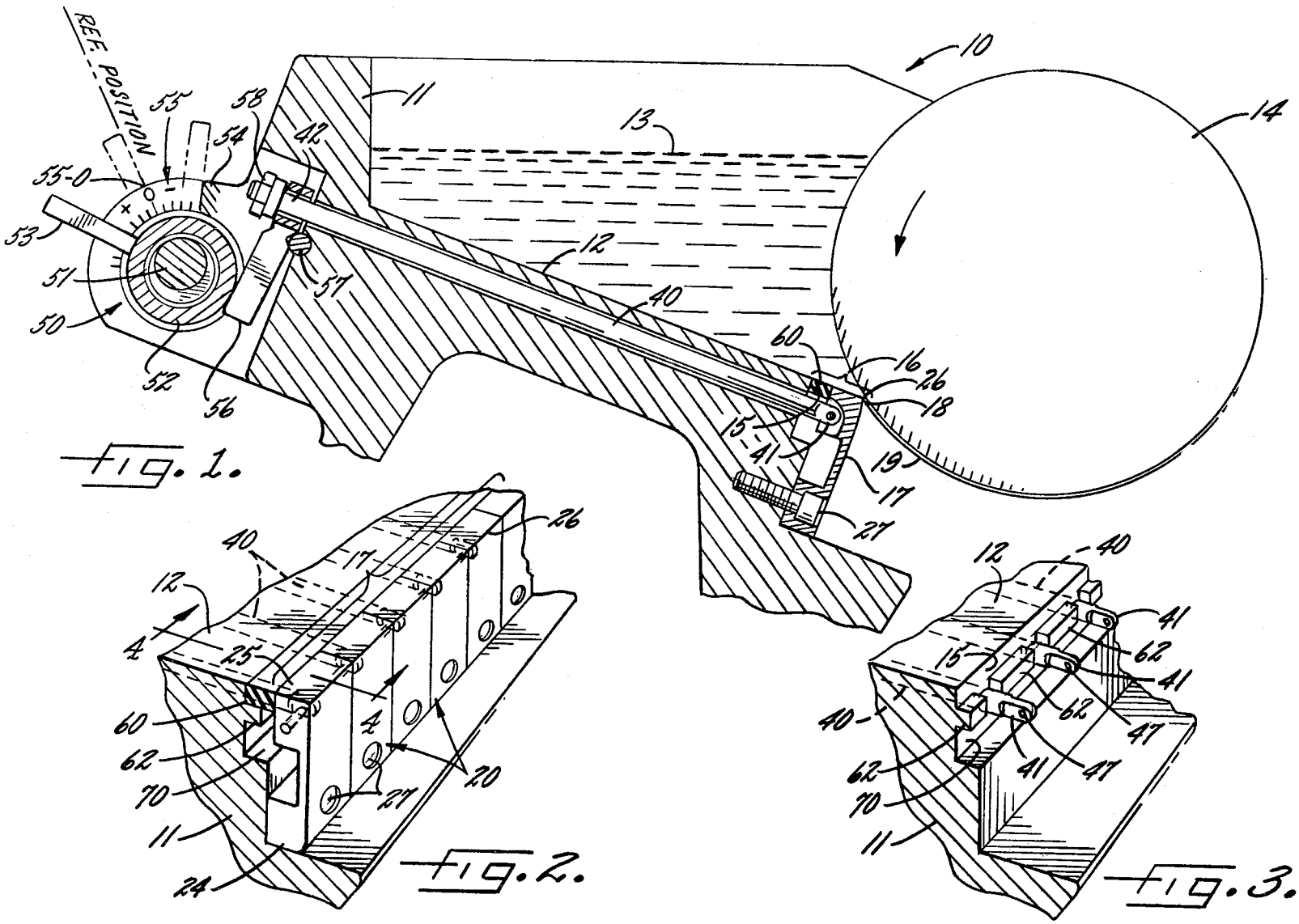
FIG. 1 shows, in transverse section, a typical ink fountain employing the present invention.
FIG. 2 is a fragmentary perspective showing the elements in the control space.
FIG. 3 is a further fragmentary perspective similar to FIG. 2 but with the flow control segments and sealing strip removed.

Turning to FIG. 1 there is disclosed an ink fountain 10 having a frame 11 which has a sloping bottom wall 12 defining a trough 13 for containment of ink adjacent a slowly driven fountain roller 14. The front edge of the frame 15 extneds adjacent and parallel to the surface of the fountain roller to define a control space 16 which is occupied by a control strip 17 defining a gap 18 through which is fed a layer or film of ink 19. The film of ink is, in turn, passed to other roller rollers within the press and eventually applied to the plate on the plate cylinder.

In accordance with the invention the flow control strip is made up of a series of separate and independent flow control segments in the form of identical blocks of rectangular shape formed of durable resilient material arranged side-by-side along the length of the fountain roller. Each control segment is rigidly secured adjacent its lower end to the frame in a position at right angles to the bottom wall of the trough, with each segment having a relatively thin central section and sprung forwardly to bias the presented upper edge of the segment against the fountain roller and each segment being equipped with a pull rod for adjustably drawing the segment rearwardly to define a gap for establishing the thickness of the ink film which is fed to the fountain roller.

Figure 4:
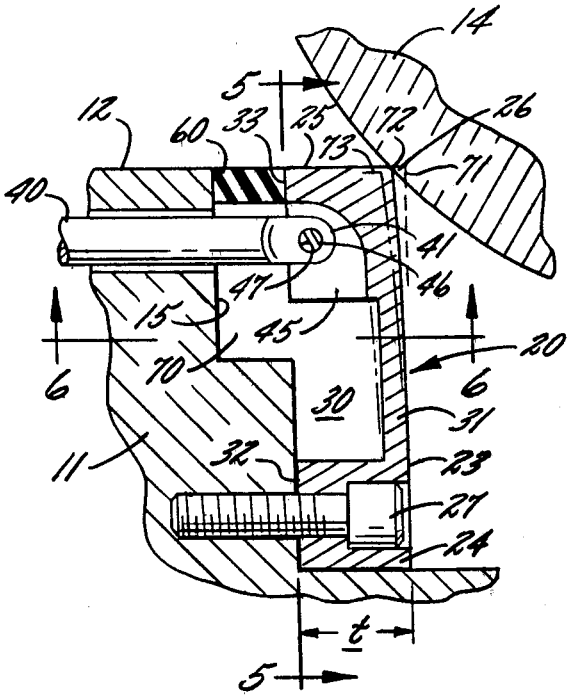
FIG. 4 is a slightly enlarged vertical section taken through one of the control segments, for example, along line 4—4 in FIG. 2.
Figure 5:
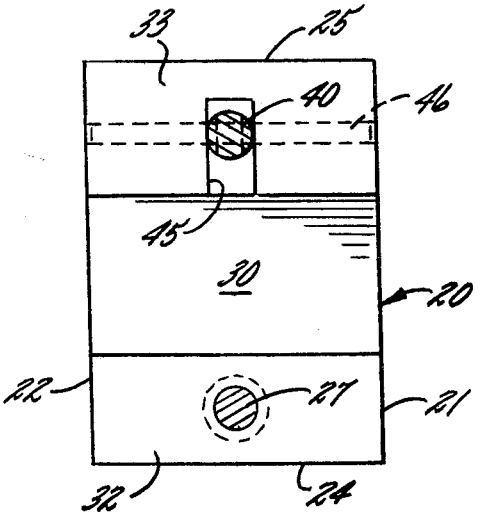
FIG. 5 is a back view looking along line 5—5 in FIG. 4.
Figure 6:
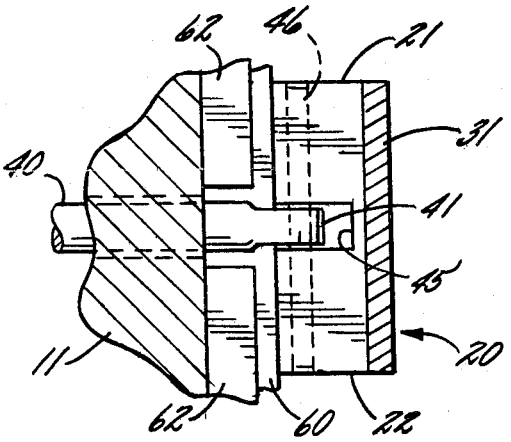
FIG. 6 shows a section taken horizontally through the control segment as viewed along line 6—6 in FIG. 4.

Taking a typical control segment 20, as individually shown in FIGS. 4 to 6, it will be seen that the segment is in the form of a block having flat lateral surfaces 21, 22, a flat front face 23, a lower end 24 and an upper end 25 having a presented edge 26 which defines the gap 18 with respect to the fountain roller. The lower end 24 of the segment is rigidly secured to the front edge 15 of the frame by means of a cap screw or the like 27, with the body of the segment being oriented at right angles to the bottom wall of the trough.

In carrying out the invention the segment is made to have a dimension t which is substantially thicker than the usual ink control element but the segment is formed with a central transversely extending notch 30 which defines an adjacent relatively thin section 31 to facilitate bending of the resilient material of which the segment is formed. The notch 30 defines a lower mounting surface 32 and an upper access surface 33 through which a pull rod 40 extends, the pull rod having a front end 41 and a rear end 42, with the pull rods 40 of all of the segments being arranged in parallel with one another as illustrated in FIG. 2.

For the purpose of coupling the front end of the pull rod to the segment 20, the upper portion 25 of the segment is provided with a pocket 45 wide enough to accommodate the end of the rod and which is bridged by a cross pin 46 which passes through a fitted opening 47 at the front end of the rod.

Further in accordance with the invention adjusting means are provided at the rear end of each pull rod including a manually positionable eccentric having adjustable throw and a throw-dividing lever interposed between the eccentric and the rod. Thus referring to FIG. 1, the manual adjusting element is in the form of a circular wedge 50 rockable on a shaft 51 and having an eccentric outer surface 52 and a control arm 53 which has a limit position against a stop 54, the stop having an associated calibrated scale 55 with which the control arm 53 cooperates.

Interposed between the eccentric surface 52 and the rear end 42 of the rod is a throw-dividing lever 56 which is piovted on a transversely extending shaft 57 to form a lever of the first class, with the upper end of the lever being coupled to the rod by means of an adjustable nut 58.

It will be apparent that uypon rocking the circular wedge 50 by rotating the handle 53 away from stop 54, the resulting throw of the eccentric surface 52, by its crowding action, rocks the throw-dividing lever 56 counterclockwise thus applying a predetermined amount of traction to the rod 40 to produce a predetermined gap 18 for feeding of ink film 19.

Prior to discussing the procedure by which the device is calibrated reference may be made to an important feature of the invention namely, a resilient sealing strip which is arranged immediately above the rods 40 and sandwiched edgewise between the front edge 15 of the frame and the back sides of the series of control segments 20. This sealing strip, indicated at 60, (see especially FIGS. 2 and 4) is mounted to have a top surface which is substantially flush witht the bottom wall 12 of the ink trough and the top surface of the flow control segment. The sealing strip has a rear edge which bears against the front edge of the frame and a front edge which bears, in common, against all of the control segments 20. The sealing strip is supported upon a relatively narrow ledge 62 (see FIGS. 2 and 3) integrally formed on the front edge 15 of the frame. In carrying out the invention the sealing strip is made of live rubber having a high degree of resiliency and has a width, when in the free or relaxed state, which is in excess by, say, twenty to thirty percent, so as to be under edgewise compression between the front edge of the frame and the flow control segments thereby to follow the movements of the individual flow control segments over their entire range of adjustment while maintaining a constant seal between the control segments of the front edge of the frame.

In order to accommodate the rearward movement of the upper portion 25 of the control segment as it is pulled by the rod to form a gap, the front edge 15 of the frame is provided with a longitudinally extending relief space 70 into which the upper end portions of all of the segments may move.

Each control segment is mounted on the frame so that its presented edge 26 is pre-sprung against the surface of the fountain roller. Specifically each segment is mounted so that in the free state this presented edge 26 would (FIG. 4) normally occupy a position 71 in which the edge would actually intersect the roller. The desired degree of springing may be achieved by placing a shim of selected thickness in back of the mounting surface 32 of the segment. Because of this springing the presented edge 26, in the absence of force applied by the pull rod 40, serves to positively seal off the ink contained in the trough.

In calibrating the flow control strip, and particularly to insure that a predetermined width of gap corresponds to a given point on the scale 55 (FIG. 1), first a zero or reference position is selected on the scale 55. Such zero or reference position is indicated at 55-0, being spaced a given number of scale units from the stop position. The nut 58 at the end of each control rod is then adjusted to a threshold condition in which the presented edge 26 of the associated segment 20 barely touches the surface of the roller to produce a barely detectable film. With each manual control adjusted to such zero or reference position all of the reference edges 26 will be in exact alignment and poised to move away from the surface of the roller in equal amounts as the control handles 53 are advanced to the same scale graduation on the positive side of the zero point. This, of course, assumes that all of the circular wedges 50 are machined to the same high tolerance. This will cause the front surfaces of the segments to move from their reference positions 72 (FIG. 4) to their retracted positions 73 with the movements of all of the segments staying in step at each division on the calibrating scale. The effect of the movement is to further compress the sealing strip 60 in the edgewise direction, but this is an idle movement readily accommodated by the resilience of the strip.

Conversely, moving the control handles 53 downscale, that is, in the "minus" direction frees each of the segments to move tightly into a sealing condition against the surface of the fountain roller by reason of its initial bias or prestress. In this connection it will be recalled that if allowed to move to its free, unstressed state the front surface of each of the control segments would occupy the intersecting position 71. Indeed, the segment would tend to take a position, in the free state, somewhat to the right of position 71 by reason of the force exerted by the sealing strip 60.

Normally the calibration procedure need be performed only once, that is, when the press is shipped from the factory but it will be appreciated that the calibration procedure is sufficiently easy and straightforward as to permit the fountain to be re-calibrated in the field whenever desired.

Nothing has been said thus far concerning the material of which the control segments are made, except to specify that the material be both durable and resilient. It is preferred, in practice, to make the control segments of springy metal, specifically steel. It is one of the advantages of the present invention that the type of steel or other metal which is used, and its central cross section, may be so chosen as to produce an extremely high spring rate or restoring force, in short, stiffness. The segments are designed so that when cantilver-mounted, as shown, a force of approximately twenty kilograms, applied at right angles to the outer extremity of the segment, is required to produce a deflection, at the gap, of one millimeter. This high inherent stiffness of the segments, while requiring relatively large forces to be developed in the pull rods, has the advantage that restoring forces are equally large so that when the mechanism is adjusted for a smaller gap positional accuracy is assured notwithstanding the accumulation of gummy or dried-on ink which may accumulate on the segments.

It will be apparent that the invention has amply met the objects set forth above. Each flow control segment is separate and independent from adjacent segments permitting separate and independent adjustment to a high order of accuracy in the setting of film thickness without the mutual interference of adjustment between adjoining areas or zones. Since all adjustments are made with each of the rods in tension throughout the entire range of adjustment there is no problem of lost motion or what is generally termed hysteresis. Thus settings are reproducible and the scale reading can be relied upon as a direct indication of the thickness of the ink film gap, not only initially but after a long period of use.

It has been found that the device is completely free of any leakage problems, with the resilient sealing strip 60 maintaining a constant and reliable seal between the front edge of the frame and the rear surfaces of the segments in all positions of adjustment of the latter. Because of the snug fitting of the adjacent segments and their thickness, resulting in a large area in engagement, there is no possibility of leakage between the adjacent segments.

The construction is, moreover, simple and inexpensive since, while the segments are employed in large number in a typical press the components are all noncritical and may be produced cheaply in quantity.

While it is preferred to employ a segment of notched construction to facilitate resilient bending, and to make the section both above and below the notch of relatively thick construction, it will be understood that the terms "thick" and "thin" are relative terms and that the term "thin" is defined as that which will produce a gap or maximum desired thickness without imposing undue strain on the manual adjusting elements located at the rear end of each of the rods. In other words, the preferred thickness of the segments illustrated in the drawings may be departed from without departing from the present invention. The term "at right angles" as used herein means an angle generally on the order of 90 degrees but which may depart therefrom as long as there is a reasonable degree of perpendicularity. The term "flush" is to be understood to refer to surfaces of adjacent elements which are about at the same level.

While it is preferred to employ a sealing strip 60 which is continuous over the length of the fountain roller, it will be understood that, if desired, such strip may be subdivided to produce parting lines coinciding with the lateral edges of the segments, in which case it may be further desirable to pre-secure each section of sealing strip to its associated segment by vulcanizing or the like.

What we claim is:

1. In an ink fountain for a printing press, the combination comprising a frame, a driven fountain roller journaled in the frame, the frame defining an ink trough having a sloping bottom wall, the front edge of the frame extending adjacent and parallel to the fountain roller to define a control space, a flow control strip in the control space, the flow control strip being made up of a series of separate and independent flow control segments in the form of identical blocks of rectangular shape formed of durable resilient material arranged snugly side-by-side along the length of the fountain roller to control the thickness of the ink film fed to the roller, each control segment being rigidly secured adjacent its lower end to the frame in a position at right angles to the bottom wall of the trough, each control segment having a relatively thin central section to facilitate bending and sprung forwardly to bias the presented upper edge of the segment against the fountain roller, a set of pull rods connected at right angles to the segments and at points spaced a short distance downwardly from the upper ends of each of them, the pull rods extending parallel to one another to the rear of the frame, positionable adjusting means at the rear end of each of the pull rods for adjustably drawing the connected segment rearwardly to define a gap between the segment and the fountain roller to establish the thickness of the ink film fed to the fountain roller in the respective zonal position, and a resilient sealing strip arranged immediately above the rods and sandwiched between the front edge of the frame and the series of flow control segments, the sealing strip being substantially flush with the bottom wall of the trough and the top surface of the flow control segments and having excess width in the free state so as to be under edgewise compression between the front edge of the frame and the flow control segments thereby to follow the movements of the individual flow control segments over the entire range of adjustment while maintaining a constant seal between the control segments and the front edge of the frame.

2. The combination as claimed in claim 1 in which the adjusting means at the rear end of each pull rod includes a manually positionable eccentric having adjustable throw and a throw-dividing lever interposed between the eccentic and the rod.

3. The combination as claimed in claim 1 in which means are provided for changing the effective length of the rod so that when the adjusting means is in a reference position the gap adjacent the respective segment is closed in threshold condition, all the adjusting means being uniformly calibrated from reference position so that uniform settings produce a uniform gap over the length of the control strip.

4. The combination as claimed in claim 1 in which each segment has a transverse notch on the backside thereof to produce a relatively thin central section, the front edge of the frame having a longitudinally extending relief to clear the upper end of the segment as it swings away from the fountain roller to form the gap.

* * * * *